United States Patent [19]

Curtis

[11] 3,948,063

[45] Apr. 6, 1976

[54] PATTERN MECHANISM

[75] Inventor: H. Leslie Curtis, Gilford, N.H.

[73] Assignee: Scott and Williams, Inc., Laconia, N.H.

[22] Filed: Oct. 21, 1974

[21] Appl. No.: 516,161

[52] U.S. Cl. ..... 66/50 R; 66/50 B

[51] Int. Cl.[2] ..... D04B 9/00

[58] Field of Search ..... 66/50 R, 50 B, 75 R, 50 A

[56] References Cited

UNITED STATES PATENTS

| | | | |
|---|---|---|---|
| 2,025,462 | 12/1935 | Lombardi | 66/50 R |
| 2,025,463 | 12/1935 | Lombardi | 66/50 B UX |
| 2,025,464 | 12/1935 | Lombardi | 66/50 R |
| 3,262,285 | 7/1966 | Beguin et al. | 66/50 R |
| 3,678,710 | 7/1972 | Gostelow | 66/50 R |
| 3,715,897 | 2/1973 | Hadam | 66/75 R |

FOREIGN PATENTS OR APPLICATIONS

| | | | |
|---|---|---|---|
| 309,465 | 4/1929 | United Kingdom | 66/50 R |

*Primary Examiner*—Mervin Stein
*Assistant Examiner*—Andrew M. Falik
*Attorney, Agent, or Firm*—McNenny, Farrington, Pearne & Gordon

[57] ABSTRACT

A pattern mechanism for a knitting machine which is adapted to selectively control longitudinal movement of needles in their slots. The needles are provided with jacks in operating relationship thereto for moving the needle in a longitudinal direction. A separate butt element is carried by the jack and is movable relative to the jack both longitudinally and transversely in at least two alternate modes. One of the modes provides lesser longitudinal free movement of the butt element relative to the jack body than the other of the modes. All of the butt elements carried by a series of jack bodies are cammed to the mode which permits greater longitudinal free movement. Selected ones of the butts are moved to the mode providing lesser longitudinal free movement so that only the jack bodies carrying the selected butt elements will be elevated by a raised cam. Therefore, only the selected needles will be raised to clear their inactive positions, while the remaining nonselected needles will remain in either a tuck or a welt position.

16 Claims, 6 Drawing Figures

Fig. 1
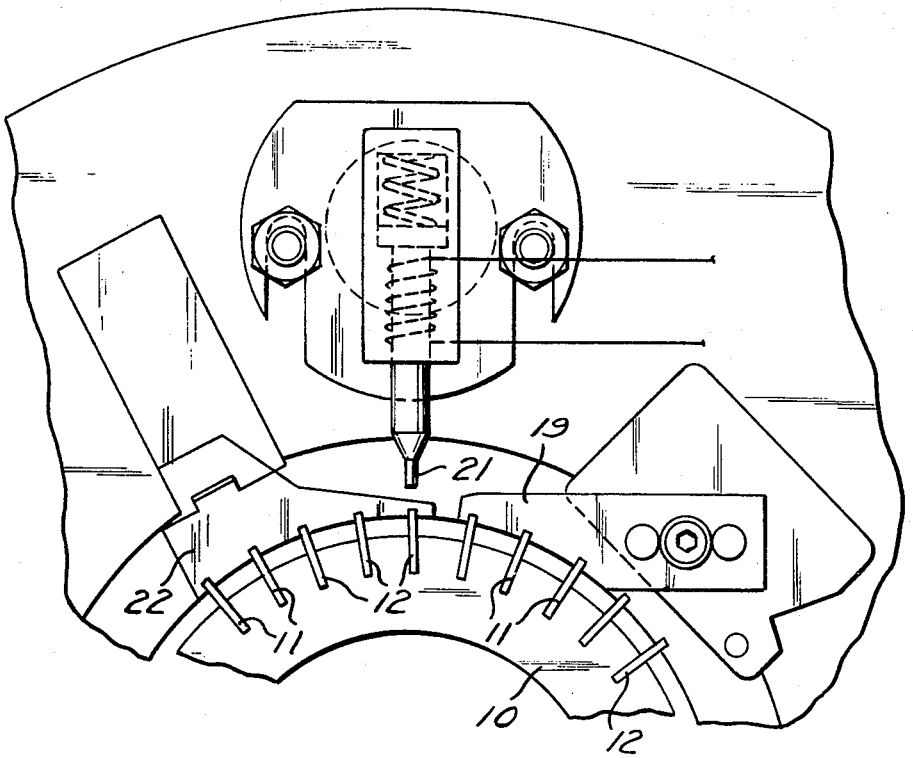
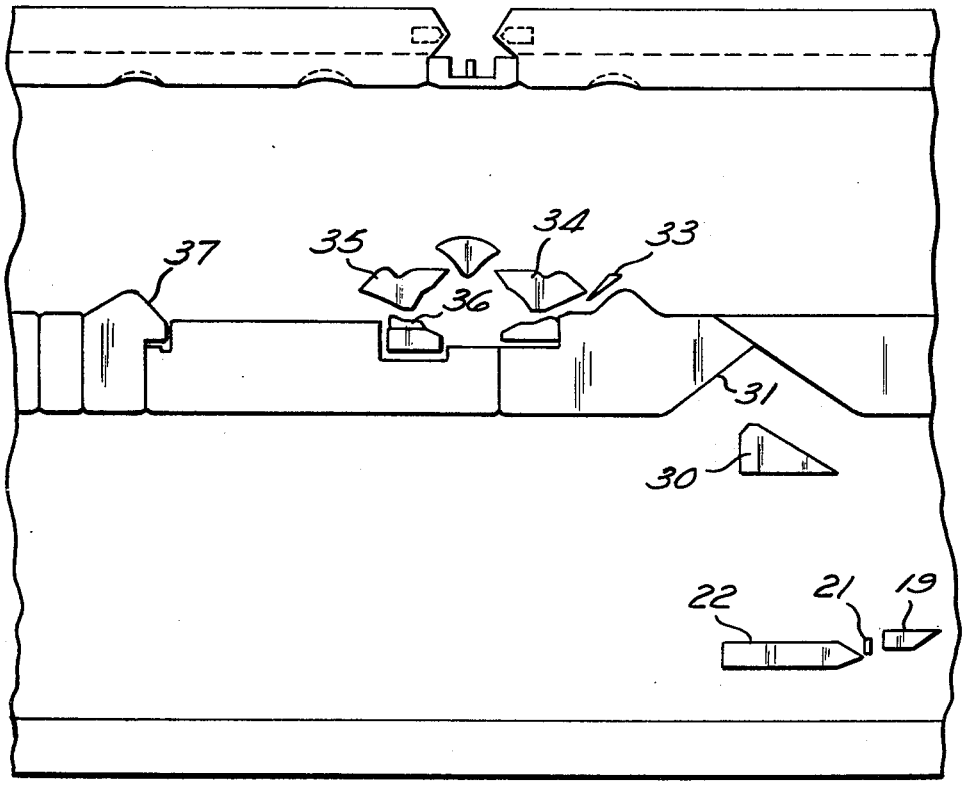
Fig. 2

PATTERN MECHANISM

BACKGROUND OF THE INVENTION

This invention relates generally to knitting machines and, more particularly, to pattern mechanisms for circular knitting machines to provide different needle heights for patterning purposes.

Patterning in knitting machines is provided generally by controlling needle height during the time the yarn is fed to the needle hooks. Patterning effects can be provided in a number of ways, including a selection between knit and tuck, or knit and welt, and/or selection of one or more yarns fed at different heights to the needles, i.e., by raising needles selectively to two different clear heights, a needle may accept and knit only one of two yarns being fed, while another needle raised to a greater clear height may accept and knit two yarns together.

Basically, patterning is provided by various camming arrangements which serve to raise or lower the needles and their actuating mechanisms together, with an additional selecting or patterning mechanism which serves to determine whether or not a needle and its related actuating mechanism will or will not be affected by the operation of one or more of the operating cams.

With this type of patterning and the need to determine which needle will be selected for a given mode of operation and which needle will not be so selected, most systems of patterning utilize one or more pattern jacks located below the needles in the needle cylinder and operable to selectively raise the needle to one of two or more alternate heights.

In patterning systems of this kind, there has been a wide variety of arrangements utilizing, among other various arrangements, one or more pattern jacks each having from one to as many as one or two dozen or more separate spaced butts on one jack, some of which may be of different projecting lengths. However, regardless of the butt arrangements and the selector means, actual selection has generally involved movement of the entire jack, either in pivotal or other similar movement radially into or out of its slot in the needle cylinder or providing an initial vertical movement to the jack which will cause the butt to selectively miss or engage another cam to complete the selecting operation.

Although many various alternate arrangements have been proposed, one of the most important problems has been to provide and maintain accurate and dependable operation as knitting speeds are increased. To increase productivity, the obvious approach is to simply increase the rotational speed of the needle cylinder. However, increased speeds mean increased loads not only on the cams and needle butts directly involved in the knitting action but also in the jacks and butts involved in the needle selection operation. In a conventional arrangement, wherein the jack is selectively rocked into or out of its slot so that the associated butt engages or misses a selecting cam, increased rotational speeds of the needle cylinder necessitate the extremely rapid selection and movement of the jacks and, although those jacks have relatively low mass, inertia problems are difficult to overcome at the speeds involved.

SUMMARY OF THE INVENTION

The present invention is directed to a novel arrangement which reduces pattern jack movement by providing a butt element movable on and carried by the pattern jack so that the selection operation is provided essentially without any movement of the jack body itself, but only by movement of a relatively small and low mass butt element carried by the jack body. The butt element is mounted in such a way that there is relative movement between the butt element and the jack body which is controlled by a suitable selector that determines whether or not the jack will be raised to thereby raise the needle to a height which is suitable for patterning.

More specifically, the present invention provides a jack having an aperture therein which carries a movable butt element. The shape of the aperture is such that the butt may be shifted transversely between a first position wherein a portion of the butt may engage a shoulder portion of the aperture to a second position wherein that portion of the butt may be received within an elongated flat portion of the aperture. Thus, if the butt is raised when it is in its first position, the shoulder portion will be engaged and the entire jack body will be raised for patterning. If, on the other hand, the butt is in its second position, the jack body will not be raised, since the butt portion will be received within the slot and there will exist lost motion between the raising cam and the jack body. Thus, as each butt passes a setting cam, each butt is engaged and moved to its second position and, therefore, all of the butts are in a position wherein a lifting cam will move the butt but will not move the jack body to any substantial degree. Between the lift cam and the set cam, however, there is provided a selector mechanism, such as a solenoid, which is operated to return certain butts to their first position. When those selected butts engage the lift cam, the jack body is raised so that another butt or butts on the jack body or on the needle will engage other lift cams, such as a tuck cam or a clear cam. The jacks having butts which are not selected will not be raised and their associated needles will remain in the welt position.

BRIEF DESCRIPTION OF THE DRAWINGS

FIG. 1 is a fragmentary plan view of the patterning arrangement, illustrating its position with respect to the needle cylinder;

FIG. 2 is an inside development of the cams controlling the movable and fixed butts.

DETAILED DESCRIPTION OF THE INVENTION

Figures 3, 4, 5, 6:
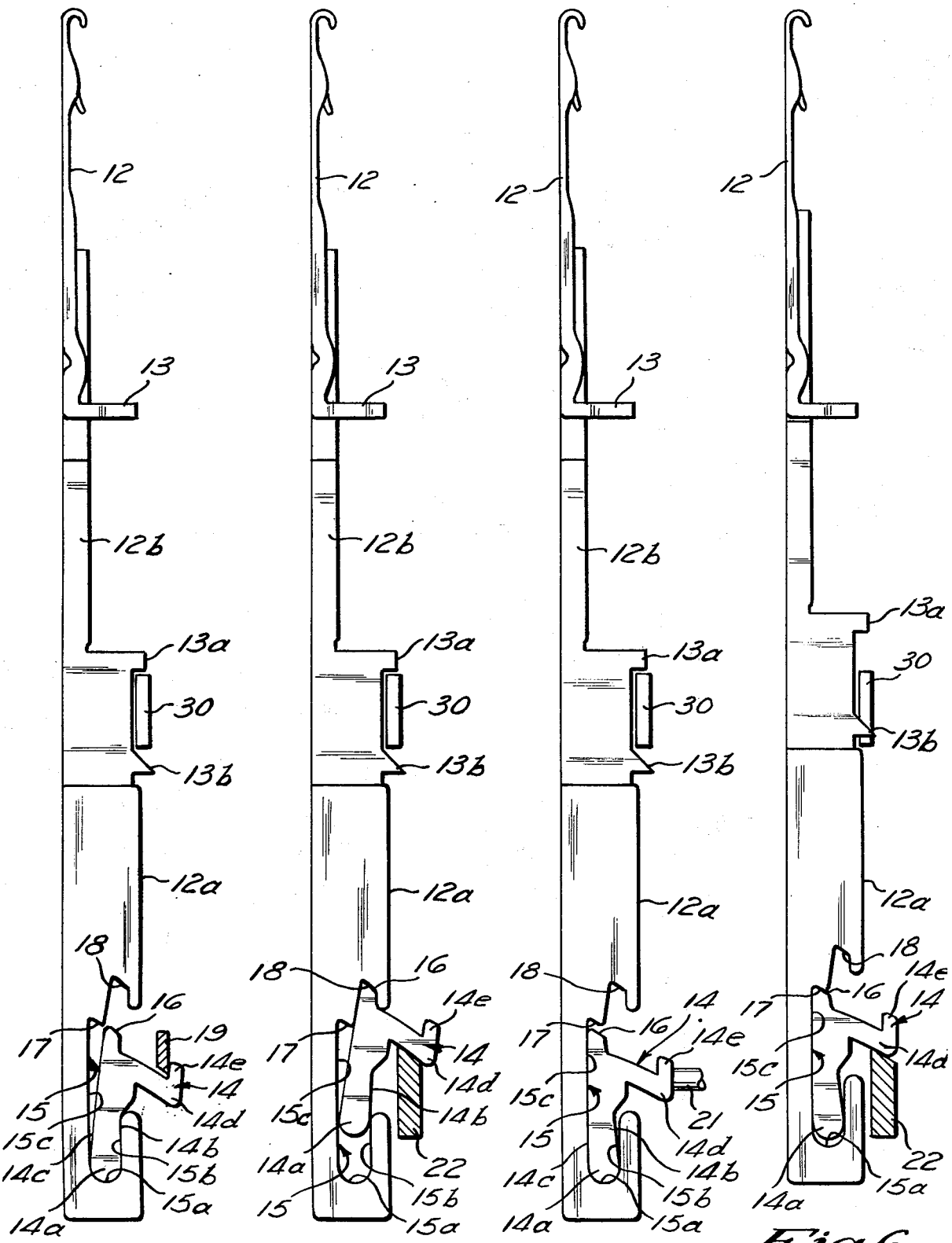
FIGS. 3 through 6 are elevational views of a needle and associated pattern and intermediate jacks according to this invention, illustrating the positioning of the movable butt element.

Referring now to the drawings, and particularly to FIG. 1, a needle cylinder assembly is shown which comprises a rotatable needle cylinder 10 provided with conventional slots 11 in which a multiplicity of needles 12 is slidably mounted. As will be appreciated, the needles are actuated by intermediate and pattern jacks, such as the illustrated pattern jack **12*a* and the intermediate jack 12*b*. The needles 12 are provided with fixed butts 13 and the intermediate jacks 12*b* are provided with fixed butts 13*a* and 13*b***. The construction and operation of the fixed butts on the needles and intermediate jacks is well known and will be described further only in connection with the operation of the pattern jacks which are the principal feature of the invention.

The pattern jacks 14 have no fixed butts, but rather have a novel movable butt element 14 positioned within an aperture 15 at the lower end of each jack 12*a*, and of substantially the same thickness as the needle so that the slots 11 will prevent displacement relative to the plane of the needle during operation. The geometry of the movable butt element relative to the aperture is such that the movable butt element is captive within the aperture. It will be understood that each pattern jack may have a plurality of movable butt elements 14 and apertures 15 positioned vertically above each other and controlled by separate needle selecting means, but only a single movable butt element and aperture are shown and described for purposes of clarity.

As shown in FIGS. 3–6, the aperture 15 at its lower end is provided with a rounded lower portion 15*a* and parallel outer and inner sides 15*b* and 15*c*. At the upper end of side 15*c* is located a re-entrant shoulder 17, above which the aperture 15 is provided with a slot 18 a spaced distance above the shoulder 17.

The movable butt element 14 includes a rounded lower pivot portion 14*a* received within the rounded lower portion 15*a* to provide a bearing support action so that the butt element 14 can rock inwardly and outwardly within the aperture 15. Thus, the butt element 14 has an outer side 14*b* engagable with the outer side 15*b* of the aperture 15 to provide a stop to limit outward rocking movement of the movable butt element 14, and likewise the butt element 14 has an inner side 14*c* adapted to engage the inner side 15*c* of the aperture to provide a stop action limit inward rocking or pivotal movement of the movable butt element within the aperture. The movable butt element 14 is also provided with a butt portion 14*d* extending radially outward beyond the body of the pattern jack 12*a* and at its outer end butt portion 14*d* is provided with an upwardly extending hook portion 14*e* as will be explained in greater detail hereinafter.

At its upper end, the movable butt element 14 is provided with a nose portion 16 which, when the butt element is in the innermost or first position with the sides 14*c* and 15*c* in engagement, is adapted to engage the shoulder 17 with only a minimal free upward or longitudinal movement of the butt element as shown in FIG. 6. It will be noted that the nose portion 16 is provided with a sloping surface matching the re-entrant shape of the shoulder 17 so that when these members are in engagement, these surfaces tend to cam or force the butt element into the first or innermost position in spite of centrifugal or other forces tending to act to move the butt element toward an outer position.

In its second or outermost position, with the side 14*b* in engagement with side 15*b*, the nose portion 16 is adapted to engage the slot portion 18, and, as shown in FIG. 4, this results in a substantially greater free upward or longitudinal movement of the butt element 14 with respect to the aperture 15 before this engagement is made. Thus, it is the difference in the amount of vertical movement of the butt element 14 between the first and second positions which allows the needle selection to take place as described in greater detail hereinafter.

When the movable butt element 14 is in the innermost position as determined by a selecting mechanism as shown in FIG. 5, upward movement of the movable butt element will serve to raise the pattern jack 12*a* and intermediate jack 12*b* as shown in FIG. 6, whereas if the movable butt element is in the second or outermost position as shown in FIGS. 3, the same amount of vertical movement applied to the movable butt element 14 will allow a greater lost motion movement until the nose portion 16 engages the slot 18 with the result that the pattern jack 12*a* and intermediate jack 12*b* will not be moved a significant distance upward as shown in FIG. 4.

Further explanation of the features of this invention is best made in connection with the structure shown in FIGS. 1 and 2. As shown in FIG. 2, the selecting takes place as shown in the lower right portion of that figure and the mechanism includes a set cam 19, a lift cam 22, and a butt actuating or pressing cam such as solenoid 21. The actual lifting of the intermediate jack 12*b* is done by the raising cam 30. The structure and operation of the other cam elements shown in FIG. 2 is best explained in connection with the following description of the operation of the selecting mechanism of this invention.

As each needle passes a set cam 19, each movable butt element is cammed to its second position by engagement of the cam 19 with hook portion 14*e* as is illustrated in FIG. 3, and each needle 12 is in a tuck position, having been raised to that position by a cam 37 which engages each needle butt 13. It will be appreciated that some of the movable butt elements may be in their second position as they approach the cam 19, but, in any event, all of the butt elements 14 are in the second position when they leave the cam 19. Each movable butt element than passes a selection station where a pattern is established. The selecting station includes a butt actuating or pressing cam or other element, such as solenoid 21, which is actuated in a predetermined timed sequence to return certain ones of the movable butt elements 14 to their first position. Only those jacks which are intended to be raised from their welt position are acted on by the solenoid.

After the jacks pass the solenoid 21 and the pattern is established, all of the movable butt elements 14 engage a lift cam 22 and all of the movable butt elements 14 are raised by the lift cam. However, those needles having butt elements in the second position are not raised by the butt element since the nose portion 16 enters the slot 18 and lost motion obtains between the butt element and the needle. In that event, and as may be seen in FIG. 4, the butts 13*a* and 13*b* do not engage a raising cam 30 and the butts of those nonselected needles are lowered from the tuck position to a welt position by a cam 33, which acts in concert with a cam 34. Those nonselected needles remain in a welt position until they reach the cam 37, since their butts will clear a primary stitch cam 35 and its cooperating cushion or cover cam 36.

However, in the case of the pattern jacks whose butt elements were shifted to the first position by solenoid 21, a different mode of operation occurs. With the butt element 14 in the first position as shown in FIG. 5, there is substantially no lost motion, and as lift cam 22 contacts the underside of butt portion 14*d*, the nose portion 16 engages shoulder 17. This causes the lift cam 22 to raise the pattern jack 12*a* a substantial amount as shown in FIG. 6 and the intermediate jack 12*b* will be raised a corresponding amount. Each butt 13*b* will then engage the cam 30 and its intermediate jack will be raised to in turn lift its needle 12 from a tuck to a clear position. A cam surface 31 then lowers each raised intermediate and pattern jack while the needle 12 remains in the clear position so that the butt of each raised needle engages the primary stitch cam 35 and its cooperating cam 36.

It should be appreciated that needle selection is accomplished by this invention without moving or rocking an entire jack but, rather, by moving a relatively low mass, movable butt element. The selection is accomplished at a single station and complicated patterning cam movements are avoided, since all of the movable butt elements are acted upon by the set and lift cams.

It should also be appreciated that other arrangements may be provided for selecting pattern jacks. For example, the cam 19 may be replaced with a suitable cam or solenoid which will move all of the movable butt elements to their first positions prior to their arrival at the selector station. The solenoid 21 may be replaced with an electromagnet which will be activated to move the butt elements of nonselected jacks to their second positions. In this instance, the movable butt elements acted on by the electromagnet are associated with jacks which are not to be raised.

While I have described my invention in connection with specific embodiments thereof, it is to be clearly understood that this is done only by way of example, and not as a limitation to the scope of my invention as set forth in the objects thereof and in the appended claims.

What is claimed is:

1. A pattern mechanism for a knitting machine to selectively control movement of a needle mounted in a slot for longitudinal movement therein comprising a jack body movably mounted in said slot to operatively control movement of said needle in at least one direction, a butt element carried by said jack body and movable both longitudinally and transversely of said jack body, said butt element having means cooperating with the jack body to produce at least two alternate modes of operation in response to transverse position of the butt element relative to the jack, one of said modes providing lesser longitudinal free movement of said butt element relative to said jack body that the other of said modes, and selector means operable to transversely position said butt element in said one or said other mode to selectively determine a corresponding degree of free longitudinal movement of said butt element relative to said jack body.

2. A pattern mechanism as set forth in claim 1 including cam means operable to engage said butt element to move said jack body in said slot, said cam means moving said jack body a greater distance when said butt element is in said one mode than in said other mode.

3. A pattern mechanism as set forth in claim 2 wherein said jack body includes an aperture, said butt element being carried in said aperture, said aperture including a shoulder engagable by said element when said butt element is in said one mode.

4. A pattern mechanism as set forth in claim 3 including a slot engagable by said butt element when said butt element is in said other mode.

5. A pattern mechanism as set forth in claim 4 including pivot bearing means on said jack body and on said butt element operable to allow said butt element to move pivotally between said one mode and said other mode.

6. A pattern mechanism for a knitting machine which is adapted to selectively control longitudinal movement of a needle in a slot, comprising a body associated with said needle and adapted to drive said needle in at least one longitudinal direction, a butt element carried by said body and movable between first and second positions, shoulder means in said body engageable by a portion of said butt element when said element is in its first position, slot means in said body adapted to receive said portion when said element is in said second position and thereby allow relative free longitudinal movement between said body and said element, first cam means for engaging said butt element to move said element to its second position, selector means to selectively return said element to its first position, second cam means to raise said element and said body if said selector means has returned said element to its first position so that said element engages said shoulder means and to raise only said element if said element is in said second position so that said element is received in said slot means.

7. A pattern mechanism according to claim 6, wherein said body comprises a jack body in driving relationship with said needle.

8. A pattern mechanism according to claim 7, wherein said selector means comprises a solenoid.

9. A pattern mechanism for a knitting machine which is adapted to selectively control longitudinal movement of needles in their slots, comprising a plurality of needles mounted for longitudinal reciprocation in slots, jack means for driving each needle in at least one longitudinal direction, a butt element carried by each jack means and being movable between first and second positions, shoulder means in each jack means engageable by a portion of said butt element when said element is in its first position, slot means in each jack means adapted to receive said portion when said element is in its second position and permit relative free longitudinal movement between said butt element and said jack means, patterning means for raising selected needles comprising a first cam for sequentially engaging all of said butt elements to move said elements to their second positions, selector means to selectively return predetermined ones of said elements to their first positions, and a second cam to raise all of said elements, whereby those jack means having elements returned to their first positions will be raised upon engagement of the element and the shoulder and those jack means having elements not returned and in their second positions will not be raised as said element enters said slot means and relative longitudinal movement between said element and jack means occurs.

10. A pattern mechanism for a knitting machine to selectively control movement of a needle mounted in a slot for longitudinal movement therein comprising a jack body movably mounted in said slot to operatively control movement of said needle in at least one longitudinal direction, an aperture in said jack body, a butt element movably carried in said aperture, a butt portion on said butt element extending out of said aperture, selecting means operatively engageable with said butt portion, said aperture and said butt element being constructed and arranged so that when said butt portion is moved in said aperture by said selecting means into a first position said butt element has limited free movement in said aperture in said one longitudinal direction with respect to said jack body, said butt element having a second position in said aperture allowing greater longitudinal free movement with respect to said jack body than said first position.

11. A pattern mechanism as set forth in claim 10 wherein said butt element includes a nose portion and said aperture has a shoulder engageable by said nose portion when said butt element is in said first position and said aperture has a slot engageable by said nose portion when said butt element is in said second position.

12. A pattern mechanism as set forth in claim 11 wherein said shoulder is formed with a reentrant surface to lock said nose portion and hold said butt element in said first position.

13. A pattern mechanism as set forth in claim 11 including bearing means on said jack body and said butt element to allow pivotal movement of said butt element between said first and second positions.

14. A pattern mechanism as set forth in claim 13 wherein said bearing means are located on the portion of said butt element away from said needle.

15. A pattern mechanism as set forth in claim 11 wherein said selecting means includes cam means operable to move said butt element to one of said positions and selectively operable means to move said butt element to said other position.

16. A pattern mechanism as set forth in claim 15 wherein said cam means moves said butt element to said second position and said selectively operable means moves said butt element to said first position.

* * * * *